US009038540B2

(12) United States Patent
Brosky et al.

(10) Patent No.: US 9,038,540 B2
(45) Date of Patent: May 26, 2015

(54) APPARATUS, METHOD AND SYSTEM FOR A BALLISTICALLY LAUNCHED DELIVERY DEVICE

(71) Applicant: CARDINAL SCIENTIFIC, INC., Waldorf, MD (US)

(72) Inventors: Andrew Paul Brosky, Waldorf, MD (US); Michael Wade Broome, Bowie, MD (US); Brian Kelly Gallion, Mechanicsville, MD (US); Charles Edmund Hebert, Waldorf, MD (US)

(73) Assignee: Cardinal Scientific, Inc., Waldorf, MD (US)

( * ) Notice: Subject to any disclaimer, the term of this patent is extended or adjusted under 35 U.S.C. 154(b) by 102 days.

(21) Appl. No.: 13/738,359

(22) Filed: Jan. 10, 2013

(65) Prior Publication Data

US 2015/0113849 A1 Apr. 30, 2015

Related U.S. Application Data

(60) Provisional application No. 61/585,628, filed on Jan. 11, 2012.

(51) Int. Cl.
*F42B 30/06* (2006.01)

(52) U.S. Cl.
CPC ..... *F42B 30/06* (2013.01)

(58) Field of Classification Search
CPC ..... F42B 30/06
USPC ..... 102/485, 484
See application file for complete search history.

(56) References Cited

U.S. PATENT DOCUMENTS

| | | | | | |
|---|---|---|---|---|---|
| 1,900,790 | A | * | 3/1933 | Brandt | 102/485 |
| 3,491,593 | A | * | 1/1970 | Bailey | 73/861.16 |
| 3,664,263 | A | * | 5/1972 | Driscoll | 102/485 |
| 3,726,036 | A | * | 4/1973 | Jennings et al. | 42/105 |
| 4,013,011 | A | * | 3/1977 | Gabriels | 102/485 |
| 4,394,836 | A | * | 7/1983 | Chavee et al. | 102/485 |
| 4,567,831 | A | * | 2/1986 | Gordon et al. | 102/485 |
| 5,099,747 | A | * | 3/1992 | Smith | 89/1.13 |
| 5,349,906 | A | * | 9/1994 | Devaux et al. | 102/485 |
| 5,448,937 | A | | 9/1995 | Buc et al. | |
| 5,574,245 | A | | 11/1996 | Buc et al. | |
| 6,176,032 | B1 | * | 1/2001 | Cohen et al. | 42/96 |
| 6,688,032 | B1 | * | 2/2004 | Gonzalez et al. | 42/105 |

(Continued)

FOREIGN PATENT DOCUMENTS

GB 2223833 A * 4/1990

OTHER PUBLICATIONS

International Search Report mailed Oct. 22, 2013 in PCT/US2013/021220.

*Primary Examiner* — Reginald Tillman, Jr.
(74) *Attorney, Agent, or Firm* — Maier & Maier, PLLC

(57) ABSTRACT

An apparatus and method of launching and retrieving a ballistically launched delivery device. A replaceable bullet trap with an axial cavity may be inserted into a launch delivery tube. The launch delivery tube may be attached to a ballistic muzzle. A projectile may be fired from the ballistic muzzle through the delivery tube and into the axial cavity of the replaceable bullet trap. An impulse and momentum of mass of the projectile may be transferred from the projectile to the replaceable bullet trap and then to the launch delivery tube to launch the launch delivery tube from the ballistic muzzle.

13 Claims, 1 Drawing Sheet

(56) References Cited * cited by examiner

U.S. PATENT DOCUMENTS

| | | | | |
|---|---|---|---|---|
| 6,981,449 | B2 | 1/2006 | Sadeck | |
| 7,526,999 | B1 * | 5/2009 | Timan | 102/502 |
| 8,701,325 | B1 * | 4/2014 | Rayner | 42/76.01 |

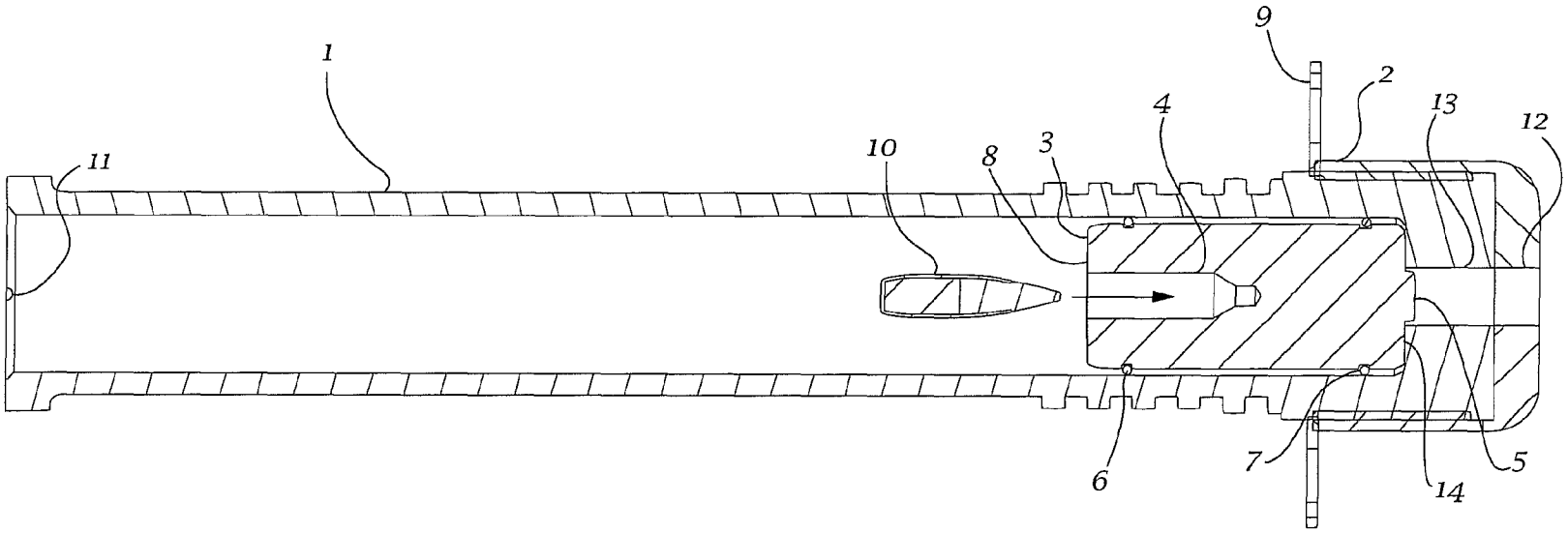
12
13
2
9
4
3
8
10
1
11
5
14
7
6

APPARATUS, METHOD AND SYSTEM FOR A BALLISTICALLY LAUNCHED DELIVERY DEVICE

RELATED APPLICATIONS

This application claims priority to U.S. Provisional Application No. 61/585,628, filed Jan. 11, 2012, the contents of which are herein incorporated by reference.

BACKGROUND

Ballistically launched devices have limited utility once fired due to projectile spalling and projectile embedment in the device. For example, spalling may damage a device due to off-axis mass transfer, while projectile entrainment may prevent safe delivery of subsequent projectiles on predictable trajectories which may lead to projectile escapement from the device.

Therefore, a need exists for controlling a projectile's mass transfer vector in a predictable manner such that the projectile embeds into a replaceable bullet trap with predictable deformation and containment allowing replacement of the bullet trap while not causing damage to the delivery device.

BRIEF DESCRIPTION OF THE INVENTION

In one exemplary embodiment, a retrievable ballistically launched delivery apparatus with a replaceable projectile controlling bullet trap may be disclosed. A launch delivery tube with an inner diameter may be provided. A replaceable bullet trap with an outer diameter may be removably inserted within the launch delivery tube. An axial cavity may be formed within the replaceable bullet trap, the axial cavity capable of receiving a projectile.

In another exemplary embodiment, a method of launching and retrieving a ballistically launched delivery apparatus may be disclosed. A replaceable bullet trap with an axial cavity may be inserted into a launch delivery tube. The launch delivery tube may be attached to a ballistic muzzle. A projectile may be fired from the ballistic muzzle through the delivery tube and into the axial cavity of the replaceable bullet trap. An impulse and momentum of mass of the projectile may be transferred from the projectile to the replaceable bullet trap and then to the launch delivery tube to launch the launch delivery tube from the ballistic muzzle.

BRIEF DESCRIPTION OF THE DRAWINGS

Advantages of embodiments of the present invention will be apparent from the following detailed description of the exemplary embodiments. The following detailed description should be considered in conjunction with the accompanying figures in which:

FIG. 1 is a cross-section view of a preferred embodiment of the retrievable ballistically launched delivery apparatus.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

While some exemplary embodiments of the invention may include line throwing devices, entanglement devices, grenade launching, line charges, grapnel hook devices, and the like, FIG. 1 depicts an exemplary embodiment of an apparatus that may be configured for a muzzle launch weapon mounted application with interchangeable tines and an attachment for a retrieval cord.

An exemplary embodiment of the invention is shown in FIG. 1 where a substantially tubular launch delivery tube 1 may have an inside diameter larger than the outside diameter of a replaceable bullet trap 3, which may allow for the free insertion of the replaceable bullet trap 3 into the launch delivery tube 1. Launch delivery tube 1 may have an annular shoulder 14 at one end to stop the replaceable bullet trap 3. The replaceable bullet trap 3 may have a rear seal 6 and a forward seal 7, which may be fixedly attached to the outer diameter and are operable to contain muzzle pressure.

The replaceable bullet trap 3 may have an axial cavity 4 with a geometry for a projectile 10. The geometry may vary depending on the particular projectile. The geometry may control and contain a mass transfer vector of the projectile 10 along the axial centerline of the cavity 4. The impulse and momentum of the mass of the projectile 10 may be transferred to the replaceable bullet trap 3, which may plastically deform in a predictable manner and further contain projectile 10. The impulse and momentum of the mass of the projectile 10 and the replaceable bullet trap 3 may be transferred to the launch delivery tube 1 through the interference of shoulder 14 and the replaceable bullet trap 3 which, along with the muzzle pressure which may be prevented from escaping by rear seal 6 and forward seal 7, may launch the apparatus from the ballistic muzzle.

The launch delivery tube 1 may have a cap 12 of durable material fixedly attached which may prevent damage to the launch delivery tube 1 upon impact. The cap may have an aperture 12. The launch delivery tube 1 may have an aperture 13 which may allow a tool to be inserted to forcibly push the replaceable bullet trap 3 free of the launch delivery tube 1, which may allow the replacement of an unfired replaceable bullet trap 3.

The replaceable bullet trap 3 may have a stub 5 on its forward face to indicate a proper insertion direction into the launch delivery tube 1. The replaceable bullet trap 3 may also have an indicator 8 which may provide an indication to the user whether the replaceable bullet trap 3 has been previously fired.

The launch delivery tube 1 may allow for attachments to be delivered by ballistic launch. For example, FIG. 1 shows an interchangeable tine 9 attached to the launch delivery tube 1. The launch delivery tube may also have an aperture 11 for attaching, for example, a retrieval cord.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A retrievable ballistically launched delivery apparatus comprising:

a launch delivery tube with an inner diameter;

a replaceable bullet trap with an outer diameter removably inserted within the launch delivery tube;

an axial cavity formed within the replaceable bullet trap, the axial cavity capable of receiving a projectile;

an annular shoulder on a front end of the launch delivery tube, the annular shoulder operable to stop the replaceable bullet trap from exiting the front end of the launch delivery tube; and at least one seal on the outer diameter of the replaceable bullet trap operable to seal against the inner diameter of the launch delivery tube.

2. The retrievable ballistically launched delivery apparatus of claim 1, wherein the inner diameter of the launch delivery tube is larger than the outer diameter of the replaceable bullet trap to allow for free insertion of the replaceable bullet trap within the launch delivery tube.

3. The retrievable ballistically launched delivery apparatus of claim 1, further comprising:

a first aperture on a front end of the launch delivery tube; and a cap with a second aperture fixedly attached to the front end of the launch delivery tube, wherein the first aperture and the second aperture are aligned.

4. The retrievable ballistically launched delivery apparatus of claim 1, further comprising:

a stub on a front end of the replaceable bullet trap designating a proper insertion direction; and an indicator on a second end of the replaceable bullet trap indicating whether the replaceable bullet trap has been previously fired.

5. The retrievable ballistically launched delivery apparatus of claim 1, further comprising:

at least one interchangeable attachment on the launch delivery tube, the at least one attachment delivered by ballistic launch.

6. The retrievable ballistically launched delivery apparatus of claim 5, wherein the at least one attachment is at least one of a tine, hook, line, or entanglement apparatus attached to an outside diameter of the launch delivery tube.

7. The retrievable ballistically launched delivery apparatus of claim 1, further comprising:

at least one retrieval cord attached to an end of the launch delivery tube.

8. A method of launching and retrieving a ballistically launched delivery apparatus comprising:

inserting a front end of a replaceable bullet trap into a proximate end of a launch delivery tube;

providing an axial cavity at a rear end of the replaceable bullet trap;

positioning the front end of the replaceable bullet trap against a shoulder at a distal end of the launch delivery tube;

providing at least one seal between an outer diameter of the replaceable bullet trap and an inner diameter of the launch delivery tube;

attaching the proximate end of the launch delivery tube to a ballistic muzzle;

firing a projectile from the ballistic muzzle through the launch delivery tube;

receiving the projectile in the axial cavity of the replaceable bullet trap;

controlling a mass transfer vector of the projectile along an axial centerline of the axial cavity;

transferring an impulse and momentum of a mass of the projectile to the replaceable bullet trap;

transferring an impulse and momentum of mass of the projectile and replaceable bullet trap to the shoulder of the launch delivery tube and simultaneously preventing escape of a muzzle pressure by the at least one seal; and launching the launch delivery tube from the ballistic muzzle.

9. The method of claim 8, further comprising:

providing at least one retrieval means to the launch delivery tube; and retrieving the launch delivery tube after launching.

10. The method of claim 8, further comprising;

providing an aperture at the distal end of the launch delivery tube to access the front end of the replaceable bullet trap;

inserting a tool into the aperture;

pushing the replaceable bullet trap free of the launch delivery tube; and replacing the replaceable bullet trap with a second replaceable bullet trap.

11. The method of claim 8, further comprising:

providing an end cap on the distal end of the launch delivery tube.

12. The method of claim 8, further comprising:

providing an indicator on the replaceable bullet trap to indicate if the replaceable bullet trap has been previously fired.

13. The method of claim 8, further comprising:

attaching at least one interchangeable attachment to the launch delivery tube.

* * * * *